US009194218B2

(12) United States Patent
Hallundbæk et al.

(10) Patent No.: US 9,194,218 B2
(45) Date of Patent: Nov. 24, 2015

(54) TUBULAR ASSEMBLY

(75) Inventors: Jørgen Hallundbæk, Græsted (DK); Paul Hazel, Aberdeen (GB)

(73) Assignee: WELLTEC A/S, Allerod (DK)

( * ) Notice: Subject to any disclaimer, the term of this patent is extended or adjusted under 35 U.S.C. 154(b) by 363 days.

(21) Appl. No.: 13/580,213

(22) PCT Filed: Feb. 22, 2011

(86) PCT No.: PCT/EP2011/052565

§ 371 (c)(1),
(2), (4) Date: Aug. 21, 2012

(87) PCT Pub. No.: WO2011/101481

PCT Pub. Date: Aug. 25, 2011

(65) Prior Publication Data

US 2012/0312561 A1 Dec. 13, 2012

(30) Foreign Application Priority Data

Feb. 22, 2010 (EP) ..... 10154277

(51) Int. Cl.
*E21B 33/128* (2006.01)
*E21B 43/10* (2006.01)
*E21B 29/10* (2006.01)

(52) U.S. Cl.
CPC ..... *E21B 43/103* (2013.01); *E21B 29/10* (2013.01); *E21B 33/128* (2013.01); *E21B 43/105* (2013.01); *Y10T 29/49826* (2015.01)

(58) Field of Classification Search
CPC ..... E21B 17/1014; E21B 33/128; E21B 33/1285; E21B 43/103
USPC ..... 166/380, 387, 207; 277/285, 645, 654; 285/15, 16, 17, 382.4; 137/15.11, 137/15.15, 15.08; 138/97, 98
See application file for complete search history.

(56) References Cited

U.S. PATENT DOCUMENTS 3,175,618 A 3/1965 Lang et al.
6,102,120 A 8/2000 Chen et al.

(Continued)

FOREIGN PATENT DOCUMENTS

SU 360789 11/1972
SU 1051222 3/1992

(Continued)

OTHER PUBLICATIONS

International Search Report for PCT/EP2011/052565, mailed Aug. 23, 2011.

(Continued)

*Primary Examiner* — Cathleen Hutchins
(74) *Attorney, Agent, or Firm* — Nixon & Vanderhye P.C.

(57) ABSTRACT

The present invention relates to a downhole tubular assembly for sealing an opening in a well tubular structure in a borehole downhole, comprising a first tubular part made of metal having an inner face, an inner diameter, an outer diameter and a first length in an unexpanded state, and a second tubular part having an outer face, an outer diameter and a second length, being arranged inside the first tubular part in an unexpanded state. Furthermore, the invention relates to a downhole system for sealing an opening in a well tubular structure in a borehole. Moreover, the invention relates to a method of sealing an opening in a well tubular structure in a borehole downhole and to a manufacturing method for manufacturing a downhole tubular assembly.

26 Claims, 17 Drawing Sheets

(56) References Cited

U.S. PATENT DOCUMENTS

| | | | | |
|---|---|---|---|---|
| 2006/0162938 | A1* | 7/2006 | Lohbeck et al. | 166/380 |
| 2009/0308656 | A1* | 12/2009 | Chitwood et al. | 175/40 |

FOREIGN PATENT DOCUMENTS

| | | |
|---|---|---|
| WO | WO 01/33037 | 5/2001 |
| WO | WO 01/98623 | 12/2001 |
| WO | WO 2005/005772 | 1/2005 |
| WO | WO 2006/098634 | 9/2006 |
| WO | WO 2008/031832 | 3/2008 |

OTHER PUBLICATIONS

International Preliminary Report on Patentability, mailed May 21, 2012.

Office Action issued in corresponding Russian Patent Application No. 2012139671/03 dated Feb. 9, 2015.

* cited by examiner

TUBULAR ASSEMBLY

This application is the U.S. national phase of International Application No. PCT/EP2011/052565 filed 22 Feb. 2011 which designated the U.S. and claims priority to EP 10154277.7 filed 22 Feb. 2010, the entire contents of each of which are hereby incorporated by reference.

FIELD OF THE INVENTION

The present invention relates to a downhole tubular assembly for sealing an opening in a well tubular structure in a borehole downhole, comprising a first tubular part made of metal having an inner face, an inner diameter, an outer diameter and a first length in an unexpanded state, and a second tubular part having an outer face, an outer diameter and a second length, being arranged inside the first tubular part in an unexpanded state. Furthermore, the invention relates to a downhole system for sealing an opening in a well tubular structure in a borehole. Moreover, the invention relates to a method of sealing an opening in a well tubular structure in a borehole downhole and to a manufacturing method for manufacturing a downhole tubular assembly.

BACKGROUND ART

In wellbores, patches or straddles are used for different purposes, such as for sealing a leak in a casing or a similar tubular structure, or for shutting off unwanted water/gas production from perforations. Patches are placed opposite the leak and expanded to abut the inside wall of the casing and thereby seal the leak. These patches often have to be run into the wellbore tubular and pass through restricted diameters within the wellbore. These restricted diameters are often referred to as "nipples".

The patches are often expanded by means of a cone. When using a cone with a fixed diameter, the diameter of the cone is governed by the nipple restrictions which the patch must pass through prior to expansion and by the inner diameter of the patch once it has been expanded. The inner diameter of the patch after expansion is approximately the size of the wellbore tubular inner diameter minus twice the wall thickness of the patch. There are some tolerances which must be taken into account during expansion and contraction due to the elastic relaxation of the patch after expansion.

In addition, there are many cases where a patch is required later on in the lifespan of the well (possibly years) below a patch which has been previously set a so-called patch through patch solution. In these cases, the inner diameter of the patch previously set may well be smaller than the nipple restrictions within the well.

In addition, well bores may be completed by means of a well tubular shallower within the well with a smaller inner diameter than the wellbore tubular in which the patch needs to be set.

In existing cases, in order to pass an earlier patch or restriction with a cone, the cone may be made expandable, which makes demands on the tool and increases the complexity of the tool and thus the cost as well as the risk of tool failure.

SUMMARY OF THE INVENTION

It is an object of the present invention to wholly or partly overcome the above disadvantages and drawbacks of the prior art. More specifically, it is an object to provide a tubular assembly which is easy to insert through an already existing patch or the like feature narrowing the passage of a tool in the casing of a tubular structure.

The above objects together with numerous other objects, advantages and features, which will become evident from the below description, are accomplished by a solution in accordance with the present invention by a downhole tubular assembly for sealing an opening in a well tubular structure in a borehole downhole, comprising:

a first tubular part made of metal having an inner face, an inner diameter, an outer diameter and a first length in an unexpanded state, and a second tubular part having an outer face, an outer diameter and a second length, being arranged inside the first tubular part in an unexpanded state, wherein the inner face of the first tubular part may be fastened to the outer face of the second tubular part before expansion and released after expansion, and wherein the first tubular part may be made of a material having a higher modulus of elasticity or Young's modulus than that of the second tubular part.

In one embodiment, a downhole tubular assembly may also be a downhole tubular sealing assembly.

Further, the second tubular part may be released from the first tubular part after expansion so that the outer diameter of the second tubular is less than that of the first tubular part after expansion.

In another embodiment, the largest outer diameter of the second tubular part may be substantially equal to the inner diameter of the first tubular part.

In addition, the largest diameter of the second tubular part may be substantially less than the outer diameter of the first tubular part.

Moreover, the second length may be substantially equal to or less than the first length.

The invention may further comprise a downhole tubular assembly for sealing an opening in a well tubular structure in a borehole downhole, comprising:

a first tubular part made of metal having an inner face, an inner diameter, an outer diameter and a first length in an unexpanded state, and a second tubular part having an outer face, an outer diameter and a second length, being arranged inside the first tubular part in an unexpanded state, wherein the inner face of the first tubular part is fastened to the outer face of the second tubular part before expansion and released after expansion and wherein the second length may be substantially equal to or less than the first length.

Also, the first tubular part may be made of a material having a first spring back ability after being expanded, and the second tubular part may be made of a material having a second spring back ability after being expanded, wherein the first spring back ability may be less than second spring back ability.

Further, the invention relates to a downhole tubular assembly for sealing an opening in a well tubular structure in a borehole downhole, comprising:

a first tubular part made of metal having an inner face, an inner diameter, an outer diameter and a first length in an unexpanded state, and a second tubular part having an outer face, an outer diameter and a second length, being arranged inside the first tubular part in an unexpanded state, the inner face of the first tubular part being fastened to the outer face of the second tubular part before expansion and released after expansion, wherein the first tubular part may be made of a material having a first spring back ability after being expanded, and the second tubular part may be made of a material having a second spring back ability after being expanded, wherein the first spring back ability may be less than the second spring back ability.

Moreover, the well tubular structure may have a substantially unchanged inner diameter after expansion.

In addition, the first tubular part may be fastened to the second tubular part along the entire length of the first tubular part or the second tubular part.

Further, the second tubular part may have a thickness which is at least 10%, preferably at least 20% and more preferably at least 50% of a thickness of the first tubular part, or vice versa.

Also, the second tubular part may have a thickness which is up to 10 times greater than a thickness of the first tubular part, or vice versa.

In one embodiment, the second tubular may be made of metal, such as aluminium, stainless steel, titanium, metal containing more than 40% nickel, shape memory alloy, spring steel, steel or iron, or any combination thereof.

Additionally, the first tubular part and the second tubular part may be fastened together in the unexpanded state, and the first tubular part and the second tubular part may be wholly or partly released from each other in the expanded state.

In addition, the first tubular part and the second tubular part may be fastened together in an unexpanded state as well as in an expanded state.

In another embodiment, the second tubular part may be made of a material having a higher yield strength than that of the first tubular part.

Furthermore, the first tubular part may be made of a material having a higher modulus of elasticity than that of the second tubular part.

Also, the second tubular part may be made of a material having a higher or lower yield strength than that of the first tubular part.

In one embodiment, the second tubular part may be wholly or partly removed from the assembly in the expanded state.

Also, the first tubular part and the second tubular part may be mechanically connected, such as press-fitted, swaged, rolled, interference-fitted or friction-fitted together.

In yet another embodiment, the first tubular part and the second tubular part may be casted or molded together.

Furthermore, the first tubular part and the second tubular part may be welded or glued together.

Moreover, the second tubular part may be fastened to the inner face of the first tubular part by means of an intermediate layer.

Said intermediate layer may be made of a material which may disintegrate when subjected to a fluid, such as acid.

Alternatively, the second tubular part may be made of a material which can disintegrate when subjected to a fluid, such as acid.

Furthermore, the second tubular part in the expanded state may be removed by milling, drilling, machining, hammering, corroding, pushing, pulling, or by pulling a retaining means, etc.

In addition, the second tubular part may be removed during expansion of the tubular assembly.

In one embodiment, the second tubular part may have a projecting flange projecting radially inwardly.

In another embodiment, the length of the second tubular part may be longer than that of the first tubular part, causing the second tubular part to project axially in one end of the assembly.

In yet another embodiment, the second tubular part may comprise a plurality of circumferential ring elements, each ring element being fastened to the first tubular part in the unexpanded state.

Furthermore, axial guide elements may be arranged between the ring elements, the guide elements having the same thickness as the ring elements.

In addition, the second tubular part may be a mesh.

Also, the second tubular part may be wholly or partly fastened to the inner face of the first tubular part.

Also, the second tubular part may be made of natural or synthetic rubber, fibre glass, plastic, such as polyamide, polyoxymethylene (POM), polyacetal, polyformaldehyde, polyether ether ketone (PEEK), polyvinyl chloride (PVC) or polytetrafluoroethylene (PTFE), or metal, such as aluminium, stainless steel, titanium, shape memory alloy, spring steel, steel or iron, or any combination thereof.

The present invention furthermore relates to a downhole system comprising:

a well tubular structure having a substantially unchanged inner diameter, a downhole tubular assembly mentioned above, and an expansion tool for expanding the first and second tubular part inside the casing.

By having a downhole tubular assembly in a well tubular structure in a downhole system, the second tubular part functions as a helping part. Thus, the expansion tool can easily pass a restriction, such as nipple or a previous expanded tubular part, e.g. a patch, due to the fact that the expansion cone can have a substantially smaller diameter than the one of the inner diameter of the well tubular structure. When having a well tubular structure that is not to change neither the inner nor the outer diameter before and after expansion of the first tubular part, also called a patch, it is very important that the expansion cone has a substantially smaller diameter than the inner diameter of the well tubular structure so that the cone can pass all the restrictions through the well to the opposite position of the opening to be sealed.

The present invention furthermore relates to a downhole system for sealing an opening in a well tubular structure in a borehole, the well tubular structure having an inner diameter, comprising:

a downhole tubular assembly as mentioned above, and an expansion tool for expanding the first and second tubular part inside the casing.

Such expansion tool may have a largest outer diameter which is substantially equal to the inner diameter of the well tubular structure minus twice the thickness of the second tubular.

Also, the expansion tool may comprise a shaft and an expansion means, such as a cone or a drift.

In one embodiment, the cone or drift may be expandable.

In another embodiment, the expansion means may comprise a heating means which is adapted to heat the first tubular part and/or the second tubular part during expansion.

Furthermore, a removable means may be arranged for wholly or partly removing the second tubular part.

In addition, the removable means may comprise a corroding mixture, such as acid, a drilling, milling or machining tool, a hammer tool, a pushing or pulling tool, or a combination thereof.

In another embodiment, the removable means may be adapted to engage the inwardly projecting flange of the second part so that the removable means pushes the second tubular part out of the first tubular part.

In yet another embodiment, the removable means may be the expansion means.

In addition, the system may be moved downhole by means of a downhole tractor, stroker or other wellbore intervention techniques.

The invention also relates to a well tubular structure comprising the previously mentioned tubular assembly.

The invention further relates to a downhole system for sealing an opening in a well tubular structure in a borehole, the well tubular structure having an inner diameter, comprising:

a first tubular part for being expanded in the casing, the first tubular part being made of metal and having an inner face, a thickness and a first length, a second tubular part having an outer face, a thickness and a second length, being arranged inside the first tubular part, and an expansion tool for expanding the first and second tubular part inside the casing, wherein the expansion tool may comprise a shaft connected with an expansion means, such as a cone or a drift.

Moreover, the expansion means may have an outer diameter, wherein the largest outer diameter of the expansion means may be substantially equal to the inner diameter of the well tubular structure minus twice the thickness of the second tubular.

Also, the inner diameter of the well tubular structure may be substantially unchanged after expansion.

Additionally, the expansion means may be radially expandable to enlarge the outer diameter of the expansion means by means of an expandable cone or drift, or by squeezing on either side of a elastomeric or rubber element.

Said expansion means may have a projection or flange projecting radially from the expansion means for retracting the second tubular after expansion.

Further, the expansion tool may comprise a retaining element connected to the expansion means by means of a wire or a shaft, and the retraction member may have an outer diameter which is larger than the inner diameter of the second tubular.

The system according to the invention may comprise a downhole tractor for movement downhole.

The system may also comprise a well tubular structure comprising a tubular assembly as mentioned above.

Moreover, the present invention relates to a method of sealing an opening in a well tubular structure in a borehole downhole, the method comprising the steps of:

determining the leakage, arranging a downhole tubular assembly opposite the leakage in the unexpanded state, expanding the tubular assembly until the first tubular is pressed towards the inner surface of the well tubular structure by moving an expansion means through the tubular assembly, and wholly or partly removing the second tubular part of the tubular assembly.

This method further comprises the step of releasing the second tubular from the first tubular by moving the expansion means free off the second tubular so that the second tubular may retract itself to have a smaller outer diameter than the inner diameter of the first tubular part.

During expansion, an outer face of a first tubular part of the tubular assembly may according to the method of the present invention be forced radially further out than an inner face of the well tubular structure.

The expanding step of said method may be performed by forcing a cone or a drift having a larger diameter than an inner diameter of the second tubular part through the tubular assembly, or by arranging a cone or a drift inside the tubular assembly and having a diameter smaller than a diameter of the second tubular part and subsequently expanding the cone or drift radially, thereby expanding the tubular assembly.

Furthermore, the expanding step may be performed by closing off the ends of the tubular assembly, thereby providing a confined area inside the tubular assembly, and subsequently pressurising the confined area by means of either a fluid or a gas.

Also, the expanding step may be performed by means of explosives.

Further, the removing step may be performed by milling, drilling, machining, hammering, pushing, pulling or by pulling a retaining means.

Finally, the removing step may be performed by adding a corroding mixture.

The invention furthermore relates to a method of sealing an opening in a well tubular structure in a borehole downhole, the method comprising the steps of:

arranging a downhole tubular assembly opposite the opening, such as a leak, expanding the first and second tubular part until the first tubular is pressed towards the inner surface of the well tubular structure by moving an expansion means through the tubular assembly, and releasing the second tubular part from the first tubular part due to the different spring back ability of the first and second tubular parts.

By spring back ability of a material is meant the condition that occurs when a flat-rolled metal alloy is cold-worked or expanded; upon release of the forming force, the material has a tendency to partially return to its original shape because of the elastic recovery of the material. The residual stresses cause the material to spring back towards its original position. This is called Springback and is influenced by the yield strength of the material.

Also, the method described above may further comprise the steps of:

making the first tubular part of a material having a first spring back ability after being expanded, and making the second tubular part of a material having a second spring back ability after being expanded, wherein the first spring back ability may be less than the second spring back ability.

The present invention furthermore relates to a manufacturing method for manufacturing a downhole tubular assembly, comprising the steps of:

making the first tubular part of a material having a first spring back ability after being expanded, and making the second tubular part of a material having a second spring back ability after being expanded, wherein the first spring back ability may be less than the second spring back ability.

In another embodiment according to the invention, the first tubular part may be made of metal, such as steel or iron.

In addition, the expansion means may comprise explosives, pressurised fluid, cement, or a combination thereof.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
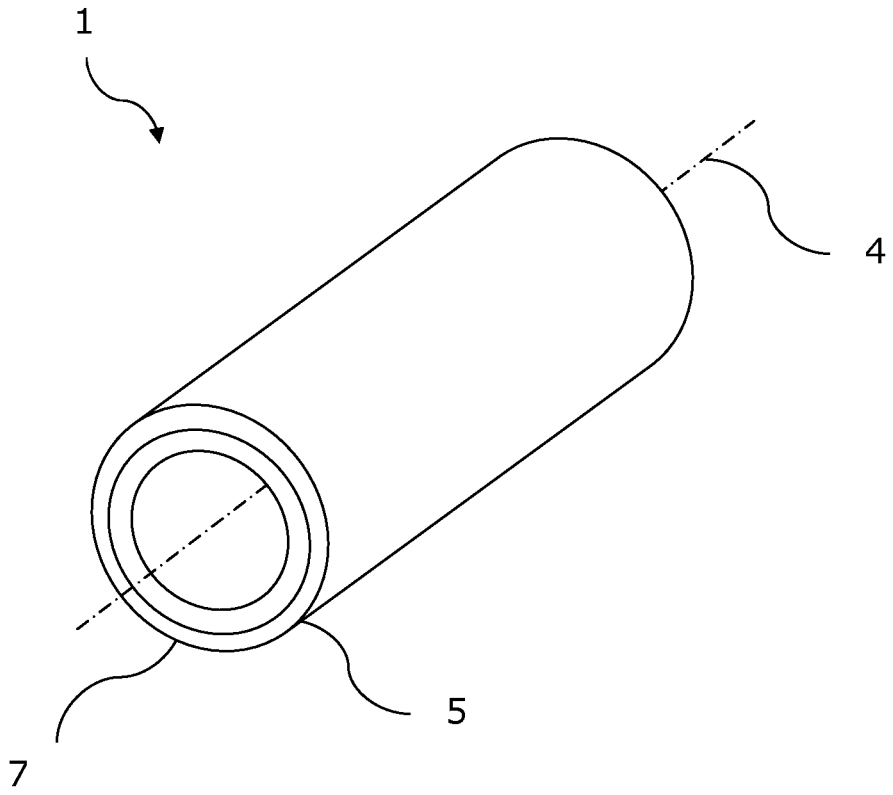
FIG. 1 shows a cross-sectional view of a tubular assembly according to the invention.

FIG. 1 shows a tubular assembly 1 before being expanded inside a well tubular structure 2 in a borehole 3. The tubular assembly 1 is to be expanded to seal an opening 25 in the well tubular structure 2 without changing the inner or outer diameter of the well tubular structure after expansion. In its unexpanded state, the tubular assembly 1 comprises a first tubular part 5 as well as a second tubular part 7 which is arranged inside the first tubular part. The first tubular part 5 functions as a patch for sealing e.g. a leak, and the second tubular part 7 helps expand the first tubular part. The first tubular part 5 has an inner face 6, and the second tubular part 7 has an outer face 8, and in its unexpanded state, the inner face of the first tubular part is fastened to the outer face of the second tubular part.

Figure 13:
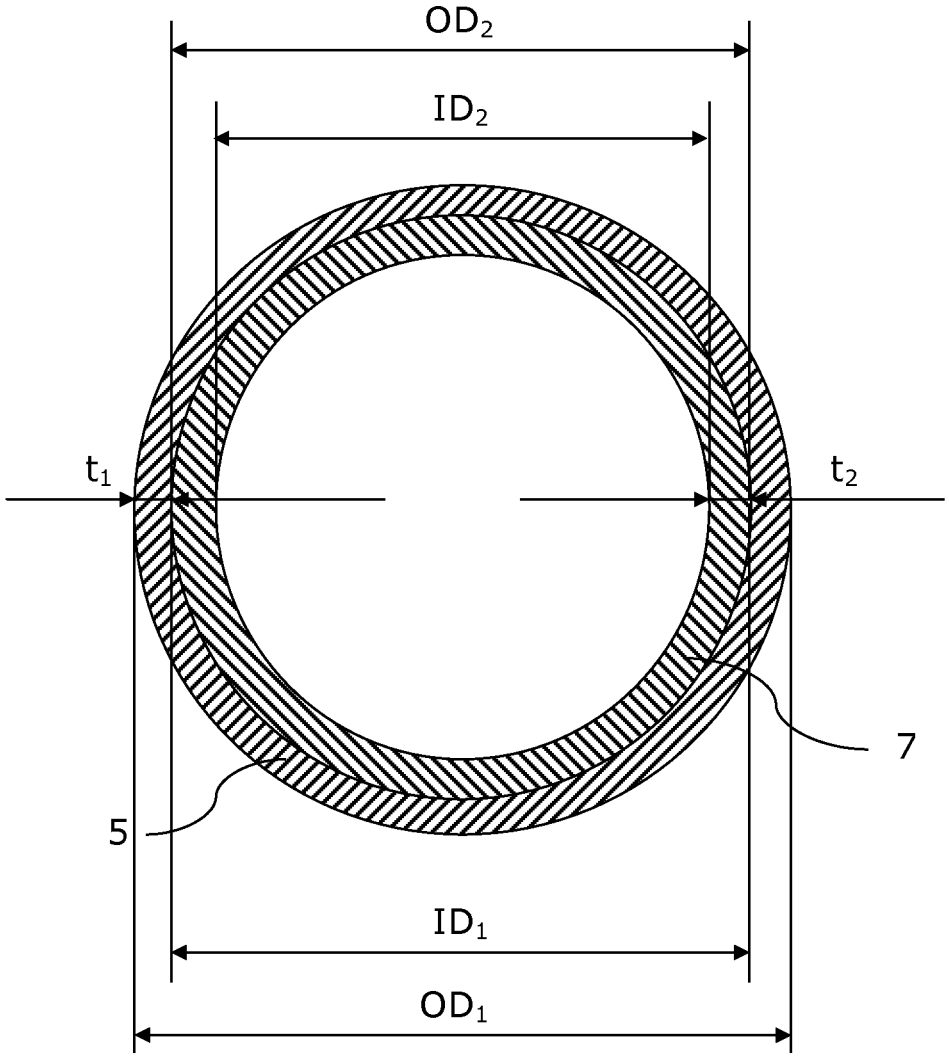
FIG. 13 shows the tubular assembly seen from one end of the same.

As can be seen from FIGS. 1 and 13, the tubular assembly 1 has a cylindrical shape and a centre line 4. The second tubular part 7 has a thickness $t_2$ which is at least 10%, preferably at least 20% and more preferably at least 50% or greater of a thickness $t_1$ of the first tubular part 5. In another embodiment, the first tubular part 5 has a thickness which is at least 10%, preferably at least 20% and more preferably at least 50% or greater of a thickness of the second tubular part 7.

As shown in FIG. 13, the first tubular part has an inner diameter $ID_1$ and an outer diameter $OD_1$ and the second tubular part has an inner diameter $ID_2$ and an outer diameter $OD_2$.

Figure 2:
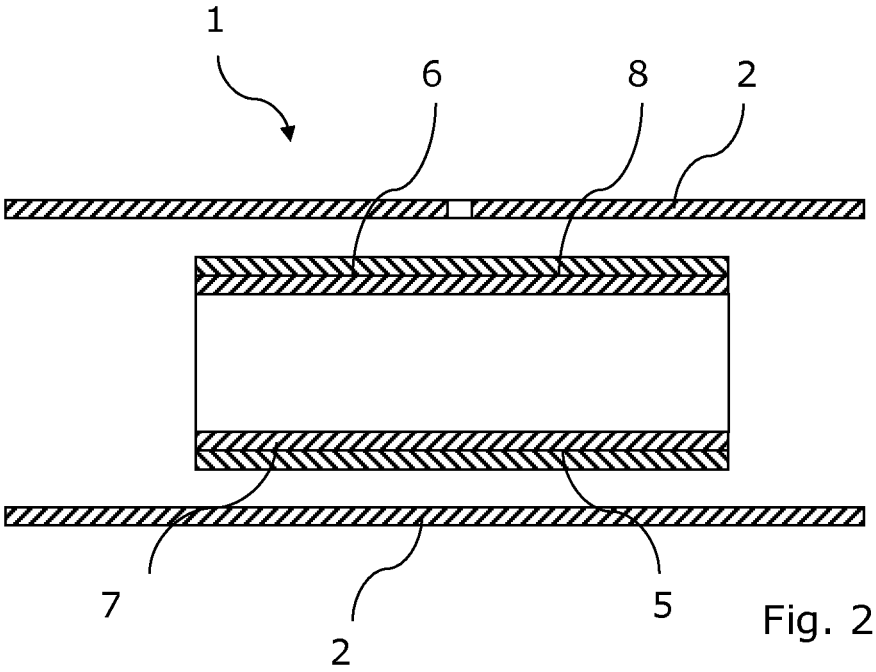
FIG. 2 shows a cross-sectional view of an unexpanded tubular assembly in a tubular structure, such as a casing.
Figure 3:
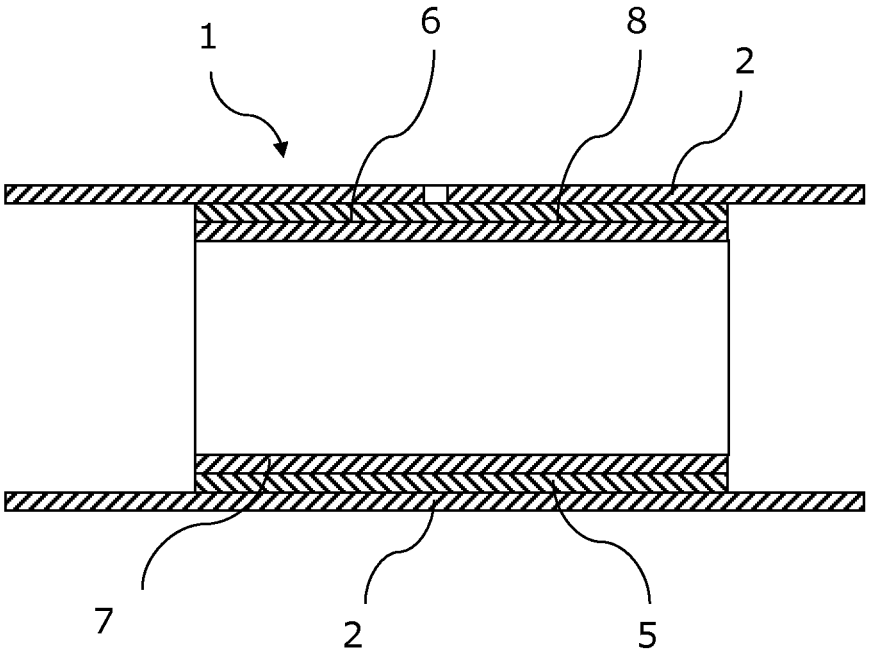
FIG. 3 shows a cross-sectional view of the tubular assembly of FIG. 2 in its expanded state.
Figure 4:
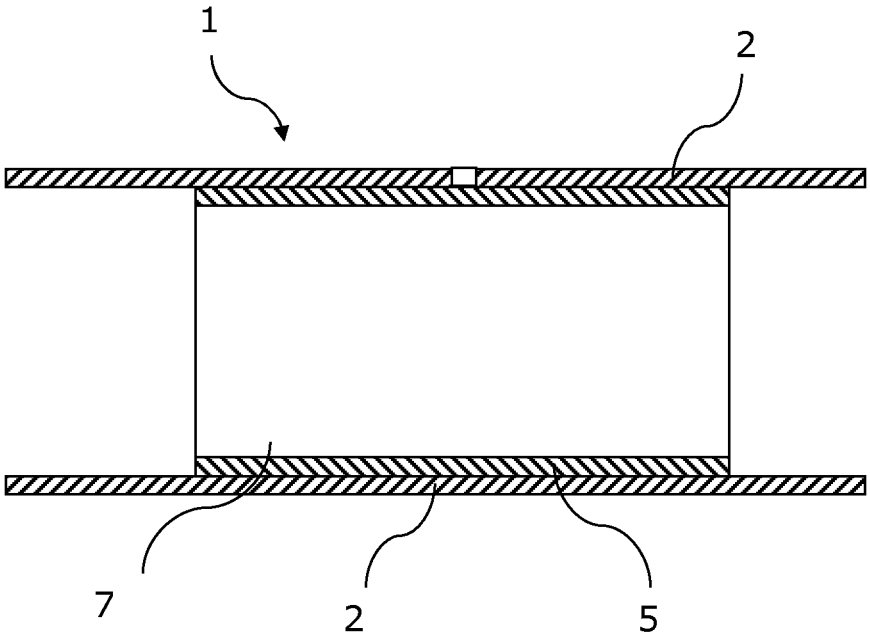
FIG. 4 shows a cross-sectional view of the tubular assembly of FIG. 2 in its expanded state after removal of the second tubular part.

FIG. 2 shows a cross-sectional view of the assembly in its unexpanded state. The first 5 and second 7 tubular parts 7 are fastened together in an unexpanded as well as an expanded state, as shown in FIG. 3. Subsequently, the second tubular part 7 is removed from the first tubular part 5, as shown in FIG. 4.

The second tubular part 7 may be removed by drilling, milling or machining it out. In this embodiment, the second tubular part 7 is made of a material which is easily drilled or milled out without damaging the first tubular part 5. The first tubular part 5 and the second tubular part 7 may be casted or molded together. The second part 7 may also be removed in other ways, such as by acid disintegrating only the second tubular part and not the first tubular part 5 of the metal.

Figure 5A:
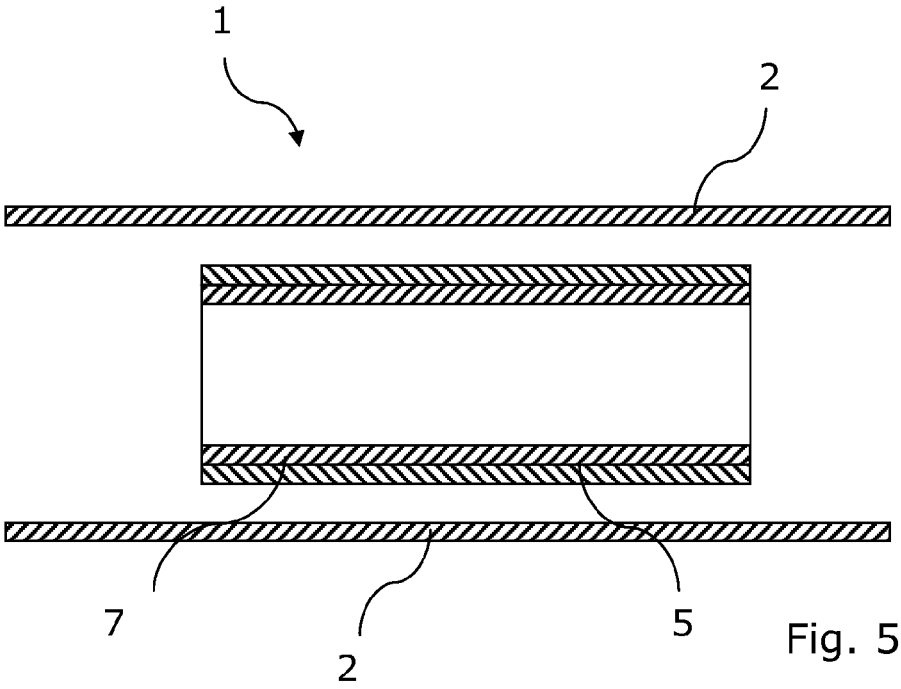
FIG. 5A shows a cross-sectional view of another embodiment of an unexpanded tubular assembly in a casing.
Figure 5B:
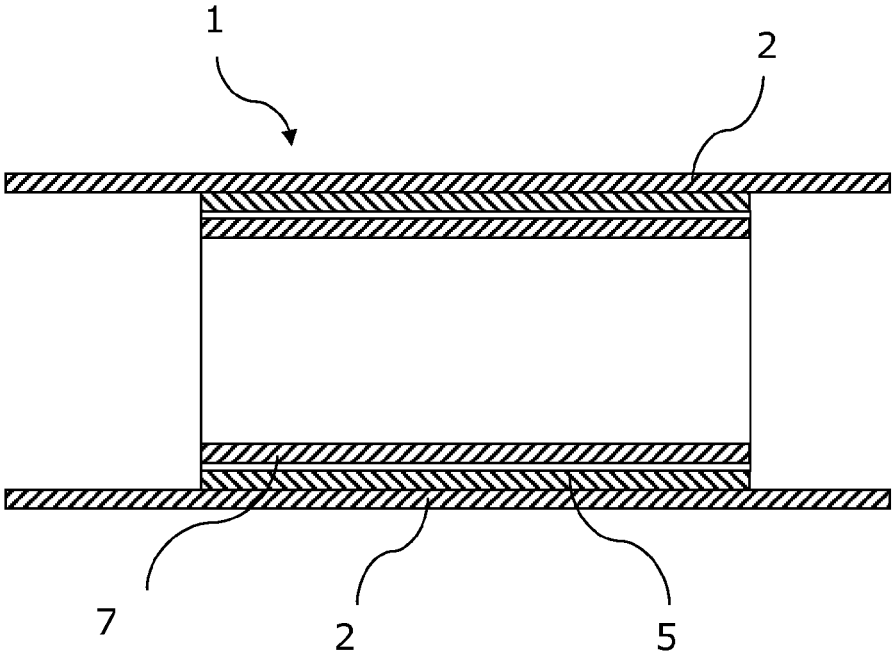
FIG. 5B shows a cross-sectional view of the tubular assembly of FIG. 5A in its expanded state.

In another embodiment, the first 5 and second tubular parts 7 of the tubular assembly 1 are fastened together in an unexpanded state, as shown in FIG. 5. After expansion, the second 7 and inner part is released from the first tubular part 5, developing a small gap between the tubular parts, as shown in FIG. 6. This is due to the spring back ability of the material. By spring back ability of a material is meant the condition that occurs when a flat-rolled metal alloy is cold-worked or expanded; upon release of the forming force, the material has a tendency to partially return to its original shape because of the elastic recovery of the material. The residual stresses cause the material to spring back towards its original position. This is called Springback and is influenced by the yield strength of the material.

In FIG. 6, the second and inner tubular part springs back more than the first tubular part, and in this way the two tubular parts depart from each other resulting in the small gap.

Figure 14A:
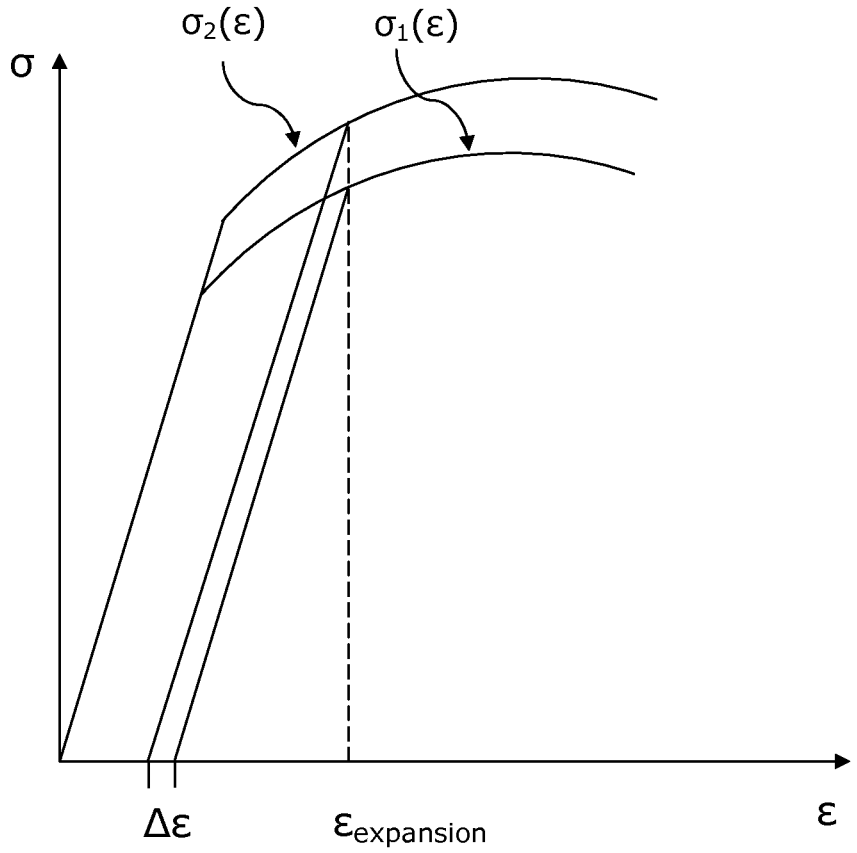
FIGS. 14A-C show stress-strain curves of the first and second tubular parts when made of different materials.
Figure 14B:
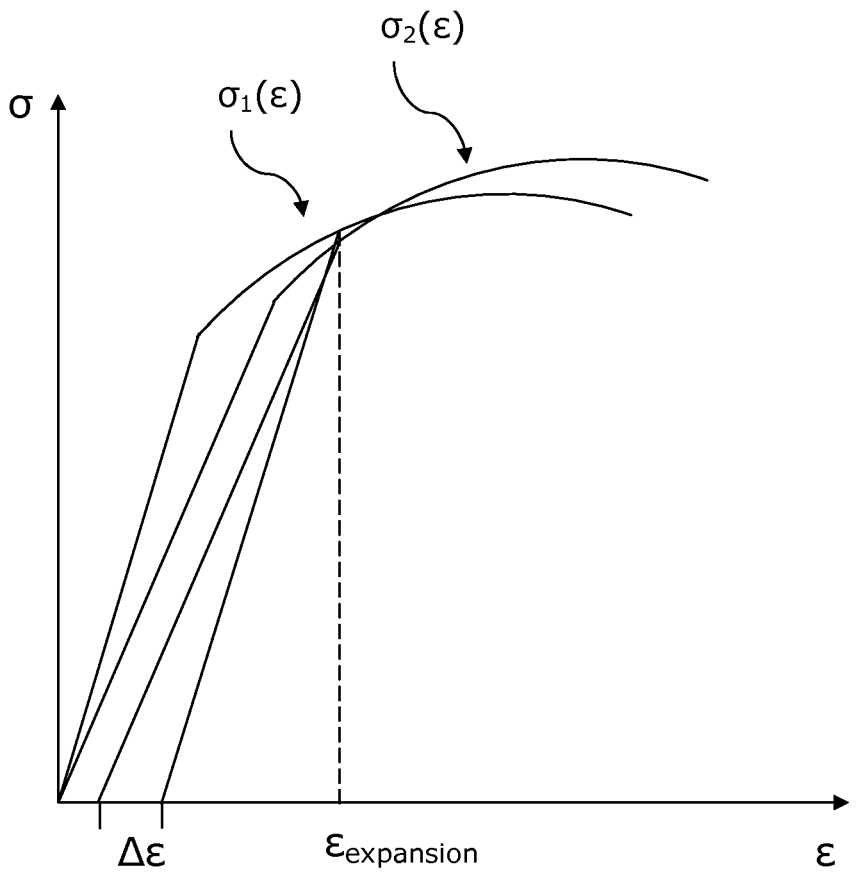
Figure 14C:
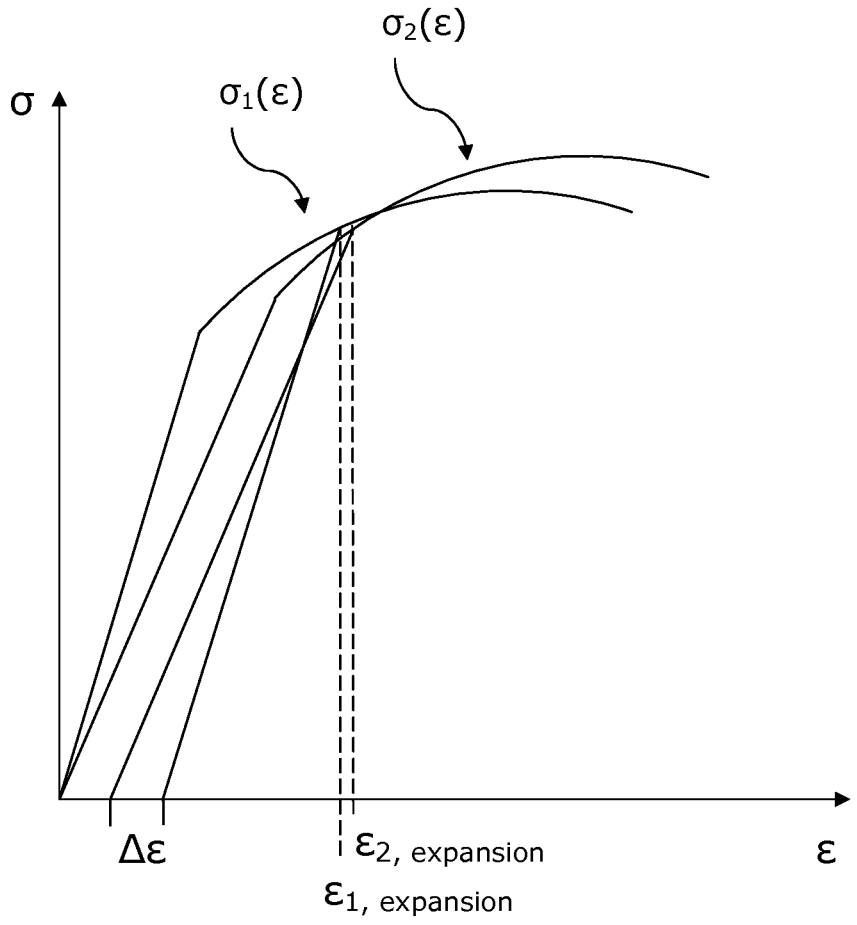

In the unexpanded state, the tubular parts 5, 7 are press-fitted, swaged, rolled, interference-fitted or friction-fitted together. In order to be able to depart after expansion, the first tubular part 5 is made of a material having a higher yield strength than that of the second tubular part 7, and/or the second tubular part is made of a material having a higher modulus of elasticity than that of the first tubular part. When the material of the first 5 and second tubular parts 7 differs in this way, the inner part relaxes radially inwardly to a higher degree after expansion than the first and outer tubular part, as illustrated in FIGS. 14A-C. In this way, the inner part is released from the first tubular part 5, forming a gap which is the result of the difference in the elastic relaxation $\Delta\epsilon$ on the stress-strain curves of the tubular parts.

In FIG. 14A, the first and second tubular parts are made of material having the same modulus of elasticity but the material of the second tubular part has a higher yield strength than the material of the first tubular part. The first and second tubular parts are expanded to $\epsilon_{expansion}$ by forcing an expansion means, such as a cone or drift in through the cavity of the second tubular part. When the expansion means has passed, the first and second tubular parts spring back along the slope of the stress/strain curves resulting in the gap $\Delta\epsilon$ between the first and the second tubular parts. Subsequently, the second tubular part can easily be removed and the first tubular part remains fastened to the inner face of the well tubular structure as a patch sealing off at least one opening 25.

In FIG. 14B, the first tubular part is made of a material having a higher modulus of elasticity than the material of the second tubular part but with a lower yield strength than the material of the second tubular part. The first and second tubular parts are expanded to $\epsilon_{expansion}$ by forcing an expansion means through the tubular assembly and relaxation, the first and second tubular parts spring back along the slope of the stress/strain curves resulting in the gap $\Delta\epsilon$ between the first and the second tubular parts. As can be seen, the gap $\Delta\epsilon$ between the first and the second tubular parts has increased by differentiating also the modulus of elasticity.

The average expansion strain $\epsilon_{2,expansion}$ of the second tubular part may vary somewhat from the average expansion strain $\epsilon_{1,expansion}$ of the first tubular part. As can be seen from FIG. 14C, this minimises the gap $\Delta\epsilon$ between the first and the second tubular parts compared to FIG. 14B. However, the gap still occurs after expansion due to the spring back effect.

As mentioned, the second part is subsequently removed and this may be done by means of a removable means, such as a retaining element 22, by dragging the second part 7 free of the first part 5. The second tubular part 7 may not necessarily be released so much that no dragging force is needed. There may still be some friction between the two parts 5, 7 even though the second part has been released so that it is no longer press-fitted to the first tubular part 5. The friction between the two parts 5, 7 may be local, meaning that some friction still remains between the two parts in predetermined positions and the second part does not move until it is dragged away, leaving the first tubular part as the patch sealing the opening 25.

An easy way of releasing the second tubular part from the first tubular part after expansion is provided when the first tubular part 5 is made of a material having a higher modulus of elasticity E than that of the second tubular part 7, and/or the second tubular part is made of a material having a higher yield strength $\sigma_y$ than that of the first tubular part. In this way, the second tubular part 7 functions as a helping tool which expands the first tubular part 5, and is easily removed after expansion. This is due to the fact that the parts flex back in the radial direction of the assembly when unstressed after expansion. As illustrated in FIGS. 14A-C, the back flexing or spring back of the parts follows the following equation:

$$\epsilon=\sigma_y/E$$

Thus, the first tubular part may be made of a material having a first spring back ability after being expanded, the second tubular part may be made of a material having a second spring back ability after being expanded, wherein the first spring back ability is less than the second spring back ability.

As shown in FIGS. 1-10, the largest outer diameter of the second tubular part is substantially equal to the inner diameter of the first tubular part in the unexpanded state of the tubular assembly. In this way, the second tubular part is easily removed after expansion even if it is not released from the first tubular part after expansion but needs to be milled or drilled out. Then the milling tool must have the range matching the outer diameter of the second tubular part.

In FIGS. 1-6, the second length of the second tubular part is substantially equal to or less than the first length of the first tubular part, making the insertion tool more simple than when the first and second tubular parts have different lengths as shown in FIGS. 7-10.

As can be seen in FIGS. 1-10, the first tubular part is fastened to the second tubular part along the entire length of the first tubular part or the second tubular part. The first 5 and the second parts 7 may also be fastened to each other in another way, such as by means of an adhesive. Such an adhesive connection is most suited as a fastening means when shear stress is present, e.g. when the tubular assembly is expanded by means of a cone. However, the adhesive is not strong enough to hold the parts together when the two parts 5, 7 depart due to the uneven flexing after expansion.

The second tubular part 7 may be wholly or partly fastened to the inner face 6 of the first tubular part 5.

The first 5 and the second parts 7 may also be fastened to each other by means of spot welding. The welded spots generate enough fastening ability to place the entire assembly in the position opposite the leak. Subsequently, the first 5 and the second parts 7 are kept in position by an expansion tool 12 when dragging the cone 10 towards the tool to expand the two parts 5, 7. When expanding the parts 5, 7, the welded spots crack, and when the tubular parts are relaxed again, they depart from each other.

Figure 6A:
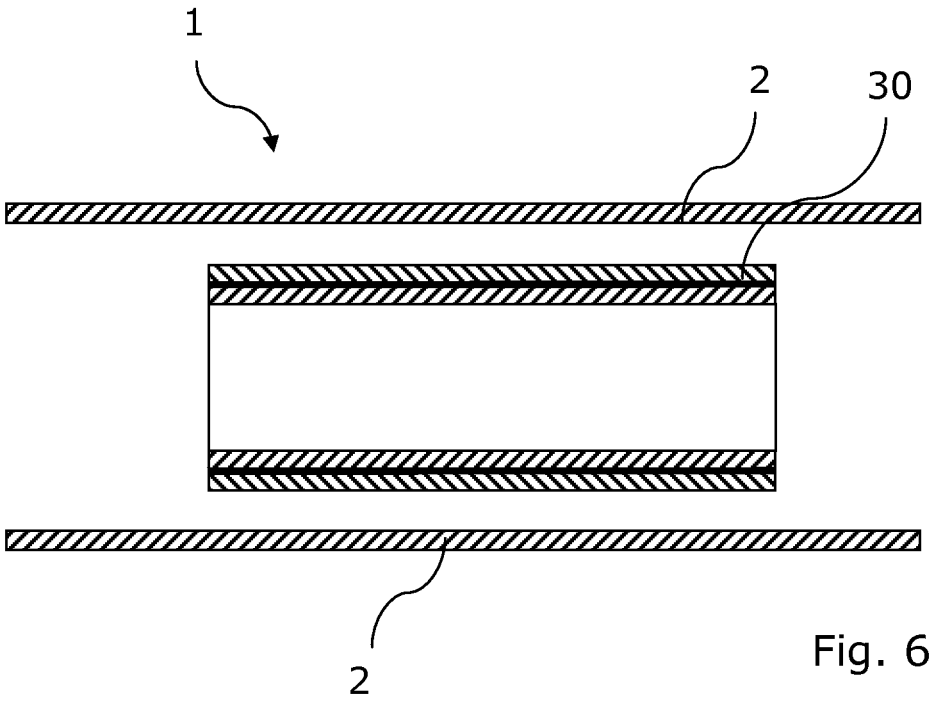
FIG. 6A shows a cross-sectional view of another embodiment of an unexpanded tubular assembly in a casing.
Figure 6B:
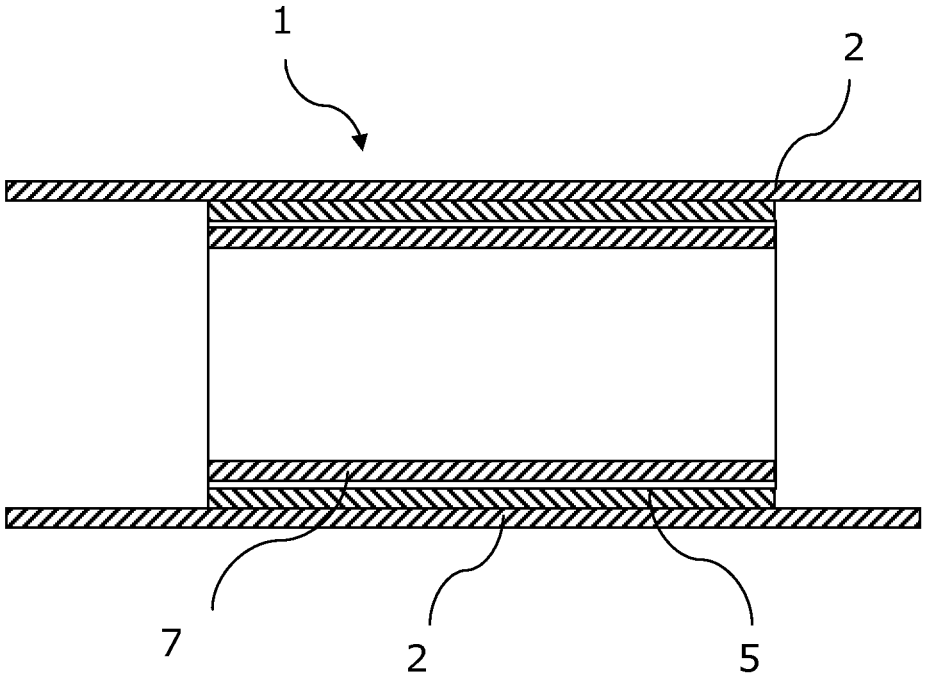
FIG. 6B shows a cross-sectional view of the tubular assembly of FIG. 6B in its expanded state

The first 5 and the second parts 7 may also be fastened to each other by means of an intermediate layer 30, shown in FIG. 6A. After expansion of the assembly, shown in FIG. 6B, the assembly is subjected to a fluid, such as acid, which disintegrates the intermediate layer 30. In this way, the tubular parts 5, 7 depart after expansion, and the second and inner part can easily be released, leaving the first part as a patch sealing the leak.

By being able to remove the second tubular part 7, the cone or another kind of expansion tool can have a smaller outside diameter than that diameter which is enough to expand the first tubular part alone, and thus, the tubular assembly 1 together with the cone can enter through an already existing patch—also called a patch through patch solution. Furthermore, the expandable cone needs not be an expandable cone, resulting in a more complex design of the expansion tool and thus leaving the risk of having more parts not functioning properly.

As mentioned, the first tubular part 5 and the second tubular part 7 are fastened together in the unexpanded state of the assembly and are wholly or partly released from each other in an expanded state.

Figure 7:
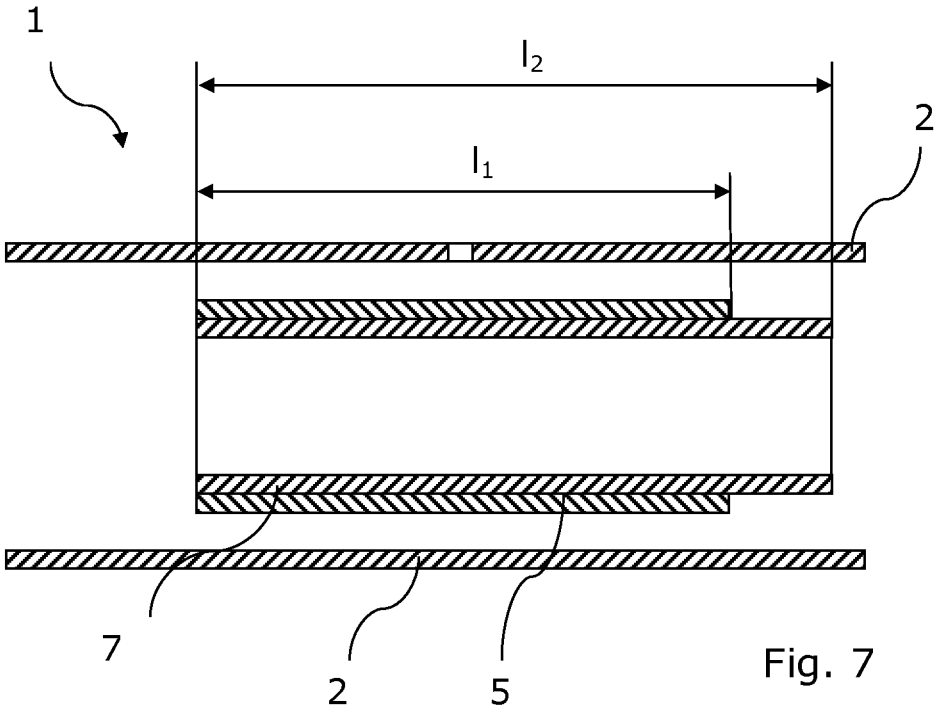
FIG. 7 shows a cross-sectional view of yet another embodiment of an unexpanded tubular assembly in a casing.
Figure 8:
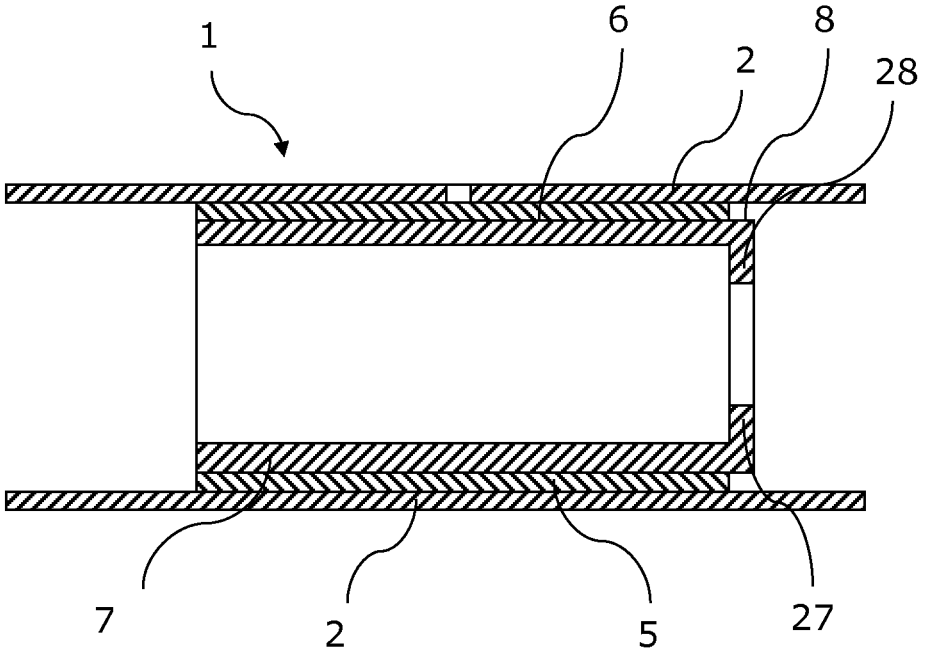
FIG. 8 shows a cross-sectional view of the tubular assembly of FIG. 7 in its expanded state.

In the tubular assembly 1 of FIG. 7, the second tubular part 7 has a length $l_2$ which is longer than the length $l_1$ of the first tubular part 5. When expanding the tubular assembly 1, the projecting length of the second tubular part 7 is drawn inward as a flange 28 projecting radially inwardly, as shown in FIG. 8. After expansion, a removable means drags the second tubular part 7 to release and moves it away from the first tubular part 5.

Figure 9:
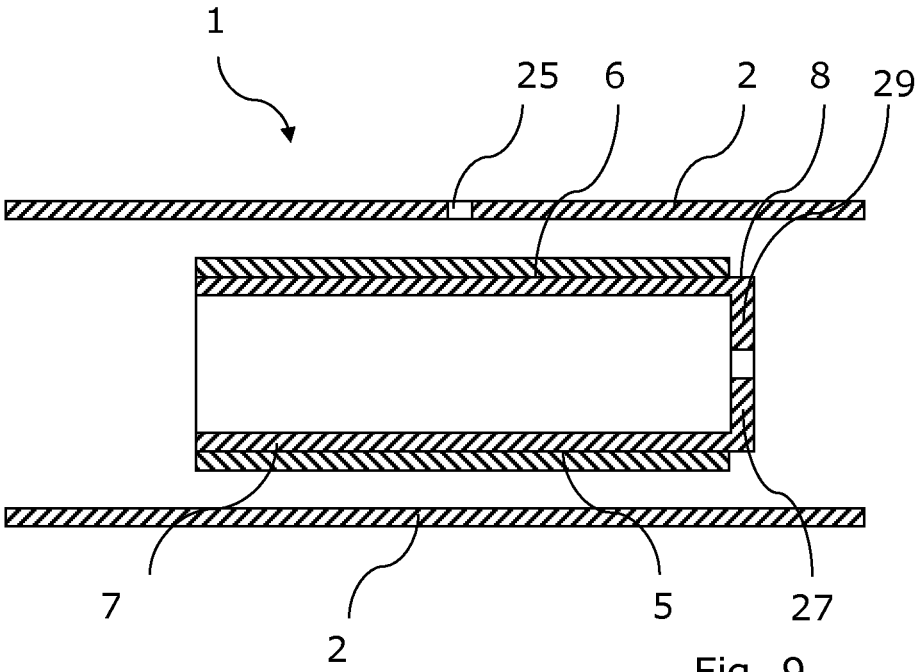
FIG. 9 shows a cross-sectional view of yet another embodiment of an unexpanded tubular assembly in a casing.
Figure 10:
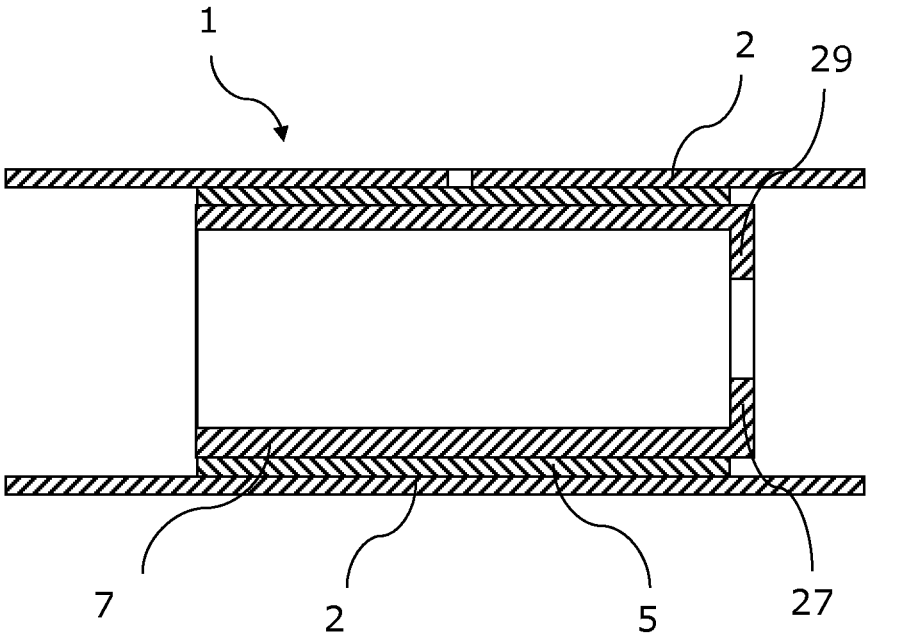
FIG. 10 shows a cross-sectional view of the tubular assembly of FIG. 9 in its expanded state.

In FIG. 9, the second tubular part 7 has a flange 29 projecting inwardly before expansion and a flange projecting inwardly after expansion of the assembly. After expansion, the removable means drags the second tubular part 7 to release and moves it away from the first tubular part 5.

In one embodiment, the second tubular part 7 comprises a plurality of circumferential ring elements, each ring element being fastened to the first tubular part 5 in the unexpanded state. The second tubular part does not have to be a full hollow cylinder in order to be able to press the first tubular part 5 outwards during expansion.

In another embodiment, axial guide elements are arranged between the ring elements, the guide elements having the same thickness as the ring elements.

When axial guide elements are arranged between the ring elements, the second tubular part 7 forms a grid. However, the second tubular part may also be in the form of a mesh.

Figure 11:
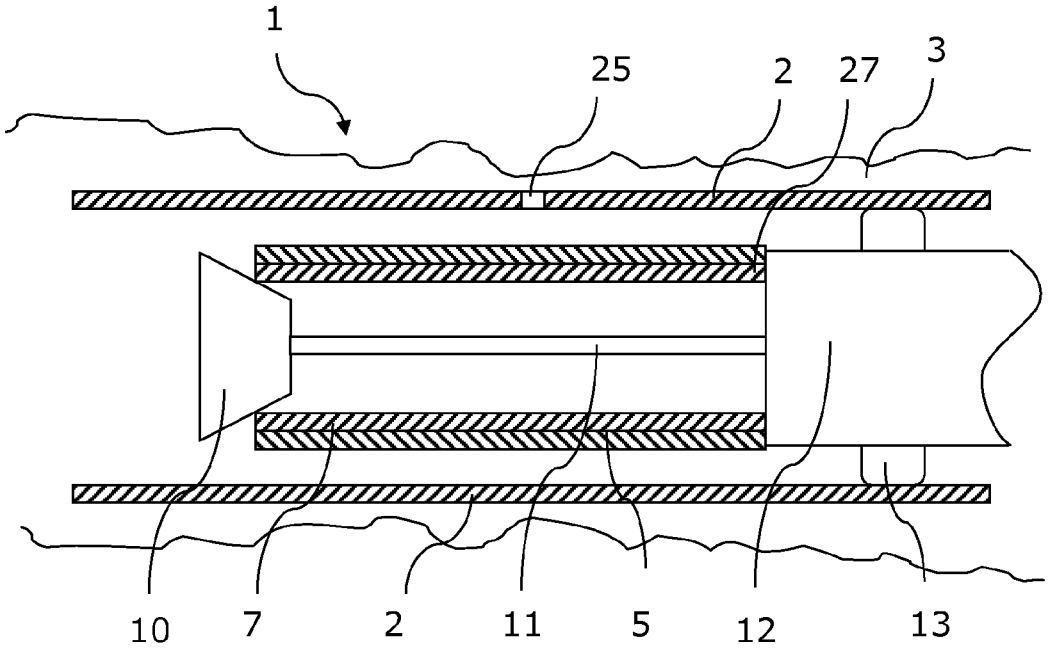
FIG. 11 shows a downhole system comprising a tubular assembly and an expansion means for expanding the assembly.

FIG. 11 shows a downhole system having a tubular assembly 1 and an expansion tool 12 having an expansion means 10 in the form of a cone or a drift. The cone is connected to the rest of the expansion tool 12 by means of a shaft 11. When inserting the tubular assembly 1, the assembly is fastened between the cone and the tool. When the tool 12 is in position opposite the leak, it anchors up inside the casing, and the expansion means is then drawn towards the tool, causing the shaft 11 to be drawn into the tool, expanding the tubular assembly 1. The expansion means has an outer diameter, wherein the largest outer diameter of the expansion means is substantially equal to the inner diameter of the well tubular structure minus twice the thickness of the second tubular.

If the tubular assembly 1 comprises a projecting flange, the expansion means 10 may be used as the removable means so that the expansion means removes the second tubular part 7 from the first tubular part 5 when the shaft 11 connected with the expansion means is retracted further into the tool, or when the tool is moved away from the first tubular part. In one embodiment, the cone or drift may be expandable.

Figure 12:
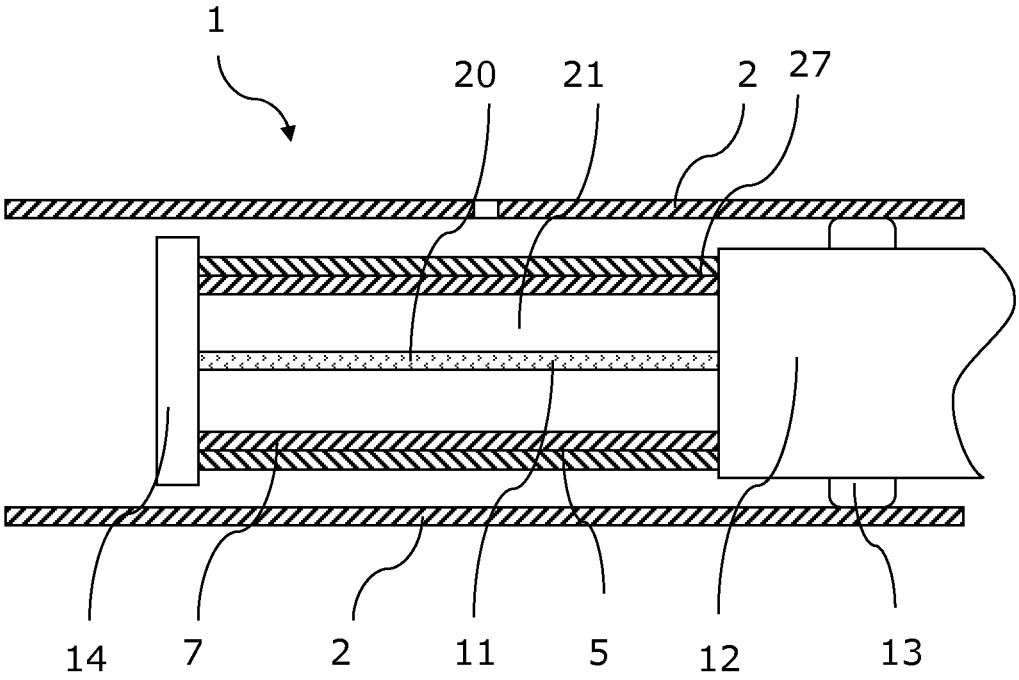
FIG. 12 shows another embodiment of a downhole system.

In the downhole system, the expansion means 10 or expansion tool 12 may also comprise explosives, pressurised fluid, cement, or a combination thereof. In FIG. 12, the tubular assembly 1 is fastened between a holding means 14 and the tool. The holding means 14 is connected to the tool by means of a shaft 11 having openings. The holding means 14, the tubular assembly 1 and the tool enclose a space or area 21 which is filled with pressurised fluid flowing through the openings in the shaft 11 in order to expand the tubular assembly 1. Subsequently, the holding means 14 is folded up and retracted. If the tubular assembly 1 has a projecting flange, the holding means 14 can also be used to retract the second tubular part 7 from the first tubular part 5. In another embodiment, the holding means 14 is retracted and replaced by a removable means which is adapted to engage the inwardly projecting flange of the second part 7 so that the removable means pushes the second tubular part out of the first tubular part 5.

After expansion, the space in FIG. 12 may also be filled with corroding mixture, such as acid, in order to remove the second tubular part 7.

Figure 15:
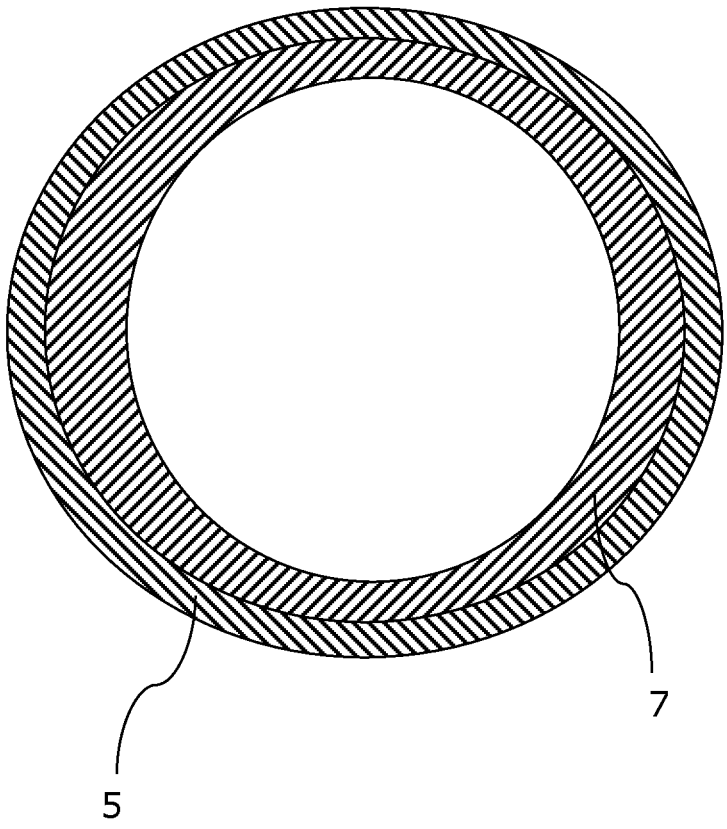
FIG. 15 shows another embodiment of a downhole system having a more resilient second tubular part.

In FIG. 15, the second tubular part 7 of the downhole system is more resilient and is able to conform to a non-circular form. The second tubular part 7 is made of a resilient material, such a rubber, which is still able to transfer the force of the cone in order to expand the first tubular part 5. In this way, the first tubular part 5 can be expanded to also press against a somewhat oval or another non-circular cross-sectional shape of the casing.

Figure 16:
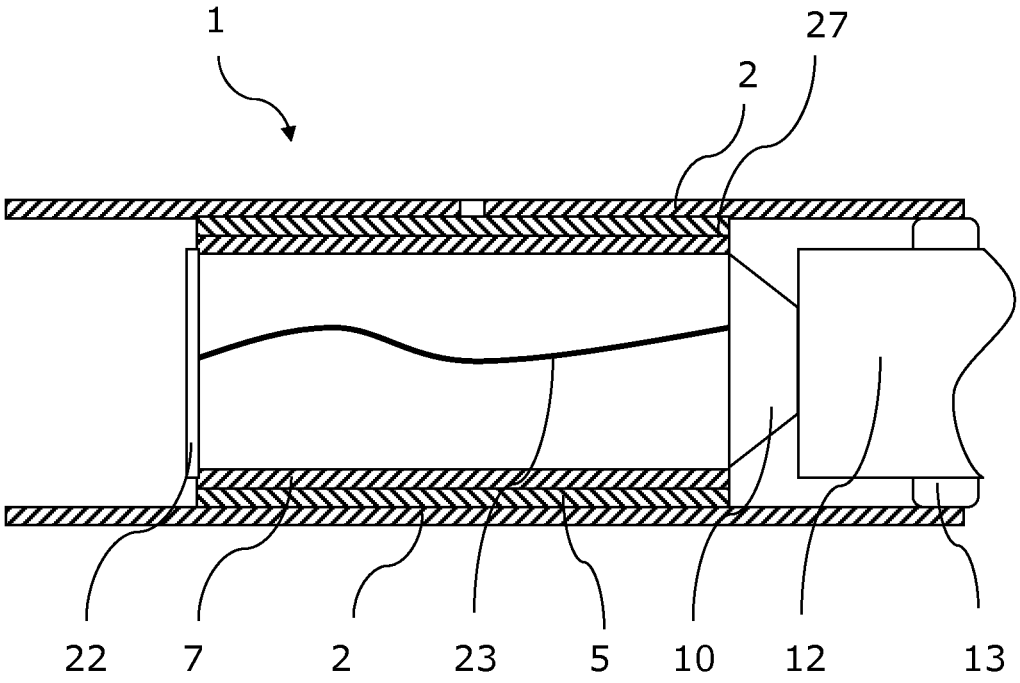
FIG. 16 shows the downhole system in which the second tubular part is fastened to the expansion tool.

In FIG. 16, the downhole system comprises a retaining element 22 in the form of a disc fastened to the expansion tool 12 by means of a wire 23 or a cable. The disc has an outer diameter which is larger than the inner diameter of the second tubular and is arranged on the outside of the second tubular part 7 in the end opposite the end 27 adjacent to the expansion tool 12 towards which the expansion cone is drawn when expanding the tubular assembly. The wire extends within the second tubular part 7, and when the tubular assembly is expanded, the disc pulls the second tubular part as the expansion tool 12 is moved away from the first tubular part 5. In this way, the second tubular part 7 is pulled away from the first tubular part 5 after expansion and is drawn towards the surface together with the expansion tool 12 comprising the expansion cone.

Figure 17:
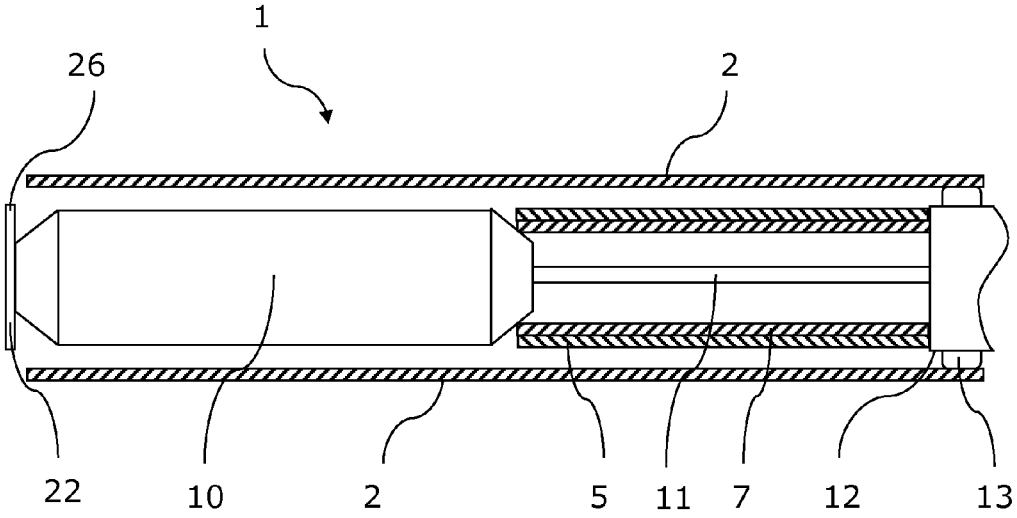
FIG. 17 shows an expansion cone holding the tubular assembly fastened between the cone and the rest of the expansion tool near the anchors and the other of the shaft than the cone itself.
Figure 18:
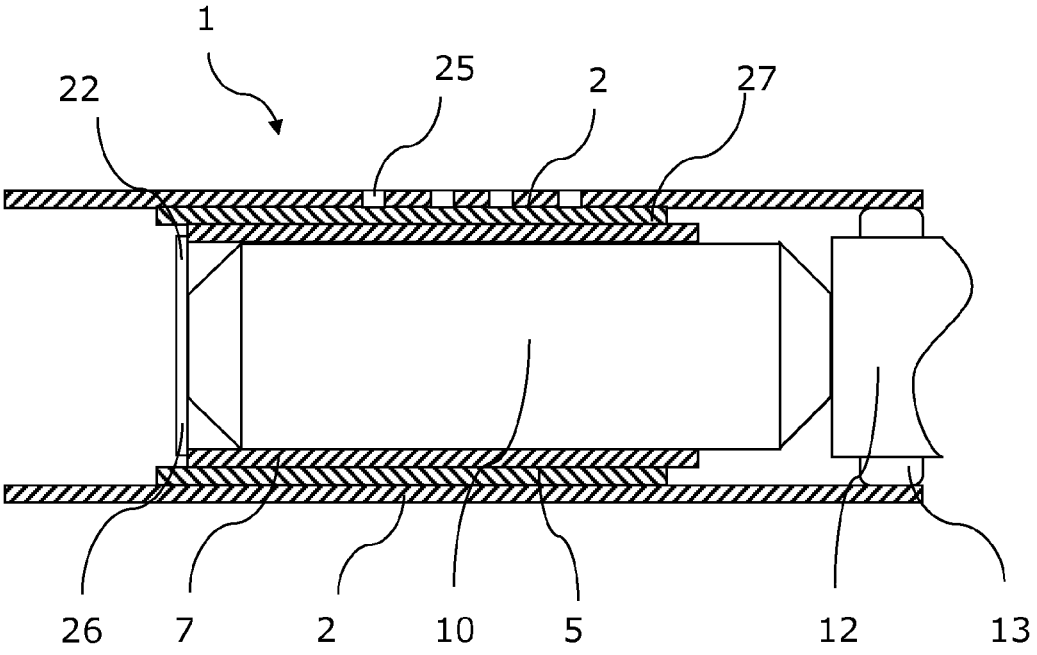
FIG. 18 shows the cone is forced through the tubular assembly and the flange forces the second tubular part along with the retraction of the cone.

In FIGS. 17 and 18, the retaining element 22 is in the form of a projection or flange 26 and projects radially from the expansion means 10 for retracting the second tubular after expansion. In FIG. 17, the expansion cone is holding the tubular assembly 1 fastened between the cone 10 and the rest of the expansion tool 12 near the anchors 13 at the other end of the shaft 11 than the cone itself. The anchors anchor the tool up inside the well tubular structure by pressing against the inner face of the well tubular structure. In this position, the tubular assembly 1 is inserted in the well tubular structure opposite the opening to be sealed. Subsequently, as shown in FIG. 18, the cone is forced through the tubular assembly 1 and the flange 26 forces the second tubular part along with the retraction of the cone and in this way the second tubular part is retracted from the first tubular part and brought up from the well along with the expansion tool.

The second tubular part 7 may also be removed by a drilling, milling or machining tool, a hammer tool, a pushing or pulling tool, or a combination thereof.

The second tubular part 7 is made of plastic, natural or synthetic rubber, fibre glass, metal, or a combination thereof. The metal may be aluminium, steel, titanium or iron, and some examples of a suitable steel material may be stainless steel, metal having more than 40% nickel, shape memory alloy or spring steel. The plastic may be polyamide, polyoxymethylene (POM), polyacetal, polyformaldehyde, polyether ether ketone (PEEK), polyvinyl chloride (PVC), or polytetrafluoroethylene (PTFE). By spring steel is meant a medium or high carbon steel alloy with a very high yield strength. The first tubular part 5 is made of metal, such as steel or iron. The first tubular part 5 is made as a patch with all the known qualities which have already been qualified for use in a well downhole. The tubular parts 5, 7 may be a cold-drawn or hot-drawn tubular structure.

When the second tubular part 7 is made of fibre glass, the expansion means 10 comprises a heating means which is adapted to heat the second tubular part 7 and/or the first tubular part 5 during expansion.

When sealing an opening 25 such as a leakage inside a well tubular structure 2 in a borehole 3 downhole, the opening 25 or leakage is determined, then the tubular assembly 1 is arranged opposite the leakage in an unexpanded state, and finally, the tubular assembly is expanded until the first tubular is pressed towards the inner surface of the well tubular structure. Subsequently, the second tubular part 7 is removed from the first tubular part 5.

The method may, before the step of removing the second tubular, comprise a step of releasing the second tubular from the first tubular by moving the expansion means through the tubular assembly, forcing the first and second tubular parts radially outwards and subsequently, the expansion means is retracted free off the second tubular so that the second tubular can retract itself to have a smaller outer diameter than the inner diameter of the first tubular part due to the spring back ability of the material.

During expansion, the first tubular part 5 of the tubular assembly 1 is forced somewhat further out radially than the inner face 6 of the well tubular structure 2, because the first tubular part 5 flexes back due to elastic relaxation as earlier discussed as spring back effect and ability of the material.

The expanding step may be performed by forcing the expansion means 10, such as a cone or a drift having a larger diameter than an inner diameter of the second tubular part, through the tubular assembly, or by arranging a cone or a drift inside the tubular assembly having a diameter smaller than a diameter of the second tubular part and subsequently expanding the cone or drift radially, thereby expanding the tubular assembly 1. By having an expandable cone or drift, the patch through patch solution becomes easier than without the expandable cone or drift. The expansion means may also enlarge the outer diameter of the expansion means by means of squeezing on either side of an elastomeric or rubber element so that the rubber element is shortened in the axial length of the expansion tool 12 while increasing its diameter in the radial direction of the expansion tool 12.

The expanding step may also be performed by closing off the ends of the tubular assembly 1, thereby providing a confined area 21 inside the tubular assembly, and subsequently pressurising the confined area by means of either a fluid or a gas.

The fluid used to expand the tubular assembly 1 may be any kind of well fluid present in the borehole 3 surrounding the tool and/or the well tubular structure 2. Also, the fluid may be cement, gas, water, polymers, or a two-component compound, such as powder or particles mixing or reacting with a binding or hardening agent.

The tubular assembly is manufactured by making the first tubular part of a material having a first spring back ability after being expanded, and making the second tubular part of a material having a second spring back ability after being expanded, wherein the first spring back ability is less than second spring back ability.

In the event that the downhole system is not submergible all the way into the casing, a downhole tractor can be used to draw or push the downhole system all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole tubular sealing assembly for sealing an opening in a well tubular structure in a borehole downhole by moving an expansion means through the tubular assembly, comprising:

a first tubular part made of metal having an inner face, an inner diameter, an outer diameter and a first length in an unexpanded state, and a second tubular part having a metal outer face, an outer diameter and a second length, and being arranged inside the first tubular part in the unexpanded state, the first tubular part being made of a metal material having a higher modulus of elasticity or Young's modulus than that of the second tubular part, and the first and the second tubular parts being adapted to be expanded, wherein the inner face of the first tubular part is fastened to the metal outer face of the second tubular part before expansion and is configured to be released from the metal outer face after expansion and the largest outer diameter of the second tubular part is substantially equal to the inner diameter of the first tubular part in the unexpanded state of the tubular sealing assembly.

2. A downhole tubular sealing assembly according to claim 1, wherein the second length is substantially equal to or less than the first length.

3. A downhole tubular sealing assembly according to claim 1, the first tubular part being made of a material having a first spring back ability after being expanded, the second tubular part being made of a material having a second spring back ability after being expanded, wherein the first spring back ability is less than second spring back ability.

4. A downhole tubular sealing assembly according to claim 1, wherein the first tubular part is fastened to the second tubular part along the entire length of the first tubular part or the second tubular part.

5. A downhole tubular sealing assembly according to claim 1, wherein a thickness of the second tubular part is at least 10% of a thickness of the first tubular part, or vice versa.

6. A downhole tubular sealing assembly according to claim 1, wherein the second tubular part is entirely made of metal.

7. A downhole tubular sealing assembly according to claim 1, wherein the second tubular part is made of a material having a higher yield strength than that of the first tubular part.

8. A downhole tubular sealing assembly according to claim 1, wherein the first tubular part and the second tubular part are mechanically connected.

9. A downhole tubular sealing assembly according to claim 1, wherein the second tubular part is fastened to the inner face of the first tubular part by means of an intermediate layer.

10. A downhole tubular sealing assembly according to claim 9, wherein the intermediate layer is made of a material which can disintegrate when subjected to a fluid.

11. A downhole tubular sealing assembly according to claim 1, wherein the second tubular part is made of a material which can disintegrate when subjected to a fluid.

12. A downhole tubular sealing assembly according to claim 1, wherein the second tubular part is made of natural or synthetic rubber, fibre glass, plastic, or metal.

13. A downhole sealing system comprising:

the well tubular structure having an inner diameter, the downhole tubular sealing assembly according to claim 1, and an expansion tool for expanding the first and second tubular parts inside the well tubular structure, wherein the inner diameter of the well tubular structure is substantially unchanged after expansion.

14. A downhole sealing system according to claim 13, wherein the expansion tool has a largest outer diameter being substantially equal to the inner diameter of the well tubular structure minus twice the thickness of the second tubular part.

15. A downhole sealing system according to claim 13, wherein the expansion tool comprises a shaft and an expansion means.

16. A downhole sealing system according to claim 13, wherein the expansion means has a projection or flange projecting radially from the expansion means for retracting the second tubular part after expansion.

17. A downhole sealing system according to claim 13, wherein the expansion tool comprises a retaining element connected to the expansion means by means of a wire or a shaft, the retraction member having an outer diameter which is larger than the inner diameter of the second tubular part.

18. A downhole sealing system according to claim 13, wherein the system comprises a downhole tractor for movement downhole.

19. A method of sealing an opening in the well tubular structure in a borehole downhole, the method comprising the steps of:

determining leakage, arranging the downhole tubular sealing assembly according to claim 1 opposite the leakage in the unexpanded state, expanding the tubular assembly until the first tubular part is pressed towards the inner surface of the well tubular structure by moving an expansion means through the tubular assembly, and wholly or partly removing the second tubular part of the tubular assembly.

20. A method according to claim 19, further comprising the step of releasing the second tubular part from the first tubular part by moving the expansion means free off the second tubular part so that the second tubular part can retract to have a smaller outer diameter than the inner diameter of the first tubular part.

21. A method according to claim 19, wherein the expanding step is performed by forcing a cone or a drift having a larger diameter than an inner diameter of the second tubular part through the tubular assembly, or by arranging a cone or a drift inside the tubular assembly and having a diameter smaller than a diameter of the second tubular part and subsequently expanding the cone or drift radially, thereby expanding the tubular assembly.

22. A method according to claim 19, wherein the removing step is performed by milling, drilling, machining, hammering, pushing, pulling or by pulling a retaining means, or the removing step is performed by adding a corroding mixture.

23. A method of sealing an opening in a well tubular structure in a borehole downhole, the method comprising the steps of:

arranging a downhole tubular sealing assembly according to claim 1 opposite the opening, expanding the first and second tubular part until the first tubular part is pressed towards the inner surface of the well tubular structure by moving an expansion means through the tubular assembly, and releasing the second tubular part from the first tubular part due to the different spring back ability of the first and second tubular parts.

24. A method according to claim 19, further comprising the steps of:

making the first tubular part of a material having a first spring back ability after being expanded, and making the second tubular part of a material having a second spring back ability after being expanded, wherein the first spring back ability is less than the second spring back ability.

25. A manufacturing method for manufacturing the downhole tubular sealing assembly according to claim 1, comprising the steps of:

making the first tubular part from metal having a first spring back ability after being expanded, and making the second tubular part from metal having a second spring back ability after being expanded, wherein the first spring back ability is less than the second spring back ability.

26. A downhole tubular sealing assembly according to claim 1, wherein the first tubular part comprises a first end, the second tubular part comprises a second end aligned with the first end in the unexpanded state, and the second length is longer than the first length in the unexpanded state.

* * * * *